US005860855A

United States Patent [19]

Alberti

[11] Patent Number: 5,860,855

[45] Date of Patent: Jan. 19, 1999

[54] DISC SIZE CLASSIFIER AND METHOD

[76] Inventor: Jerome Jean Andre Alberti, 17 Rue Catherinot, 18000 Bourges, France

[21] Appl. No.: 845,622

[22] Filed: Apr. 25, 1997

[51] Int. Cl.[6] ..... G07D 3/10

[52] U.S. Cl. ..... 453/5; 209/682; 150/112

[58] Field of Search ..... 453/5, 8; 209/680, 209/682; 150/112–117, 136, 145, 150–153

[56] References Cited

U.S. PATENT DOCUMENTS

| | | | |
|---|---|---|---|
| 1,379,817 | 5/1921 | Hegwer | 150/117 |
| 1,807,655 | 6/1931 | Eriksson | 453/5 X |
| 3,603,325 | 9/1971 | Beerens | 453/5 |
| 3,757,840 | 9/1973 | Herbener . | |
| 5,184,657 | 2/1993 | Hatchman . | |

FOREIGN PATENT DOCUMENTS

| | | | |
|---|---|---|---|
| 2563 | 12/1913 | United Kingdom | 453/5 |

*Primary Examiner*—F. J. Bartuska
*Attorney, Agent, or Firm*—Michael B. Jolly

[57] ABSTRACT

A coin classification apparatus and method which is adaptable to a purse, wallet or as a separate coin purse. The apparatus comprises a plurality of stacked troughs, equalling the number of coin sizes to be classified. Each trough is equipped with a plurality of restriction apertures which restrict the passage of coins larger than the aperture but allow the passage of all other coins, the apertures on a given trough are the same size. The top trough has the largest apertures while the bottom trough has no apertures. Loose coins are deposited in the top trough and coins are classified in separate troughs as smaller coins pass successively through apertures.

22 Claims, 3 Drawing Sheets

DISC SIZE CLASSIFIER AND METHOD

BACKGROUND OF THE INVENTION

The object of this invention is to provide an apparatus and method for separating discs of varying diameter. The apparatus may be adaptable to classifying coins, metal washers, and other flat discs. Furthermore the apparatus may be made as a separate unit or as an integral part of a purse, wallet or other personal currency container. The apparatus operates automatically and separates discs based on size and further displays the size classified discs in separate troughs for each disc size. The separate trough display also provides an easy access means for retrieving discs as needed. The inventor is unaware of a prior device which automatically separates discs based on size and further can be adaptable to be included as a coin classifier and as part of a wallet or purse.

Accordingly an object of this invention is to provide an apparatus which separates discs based on diameter size and retains the diameter classified discs in separate troughs for easy access when needed. Furthermore it is an object to provide a disc size classifier which adaptable to classifying currency coin and which apparatus may be adaptable to a wallet or purse. Also, the device operates automatically, relying only on gravity and the slight agitations experienced by a purse or wallet when carried by a person. It is also an object to provide an apparatus which may be utilized to separate washers and other metal discs by size diameter.

DETAILED DESCRIPTION OF THE DRAWINGS

Figure 1:
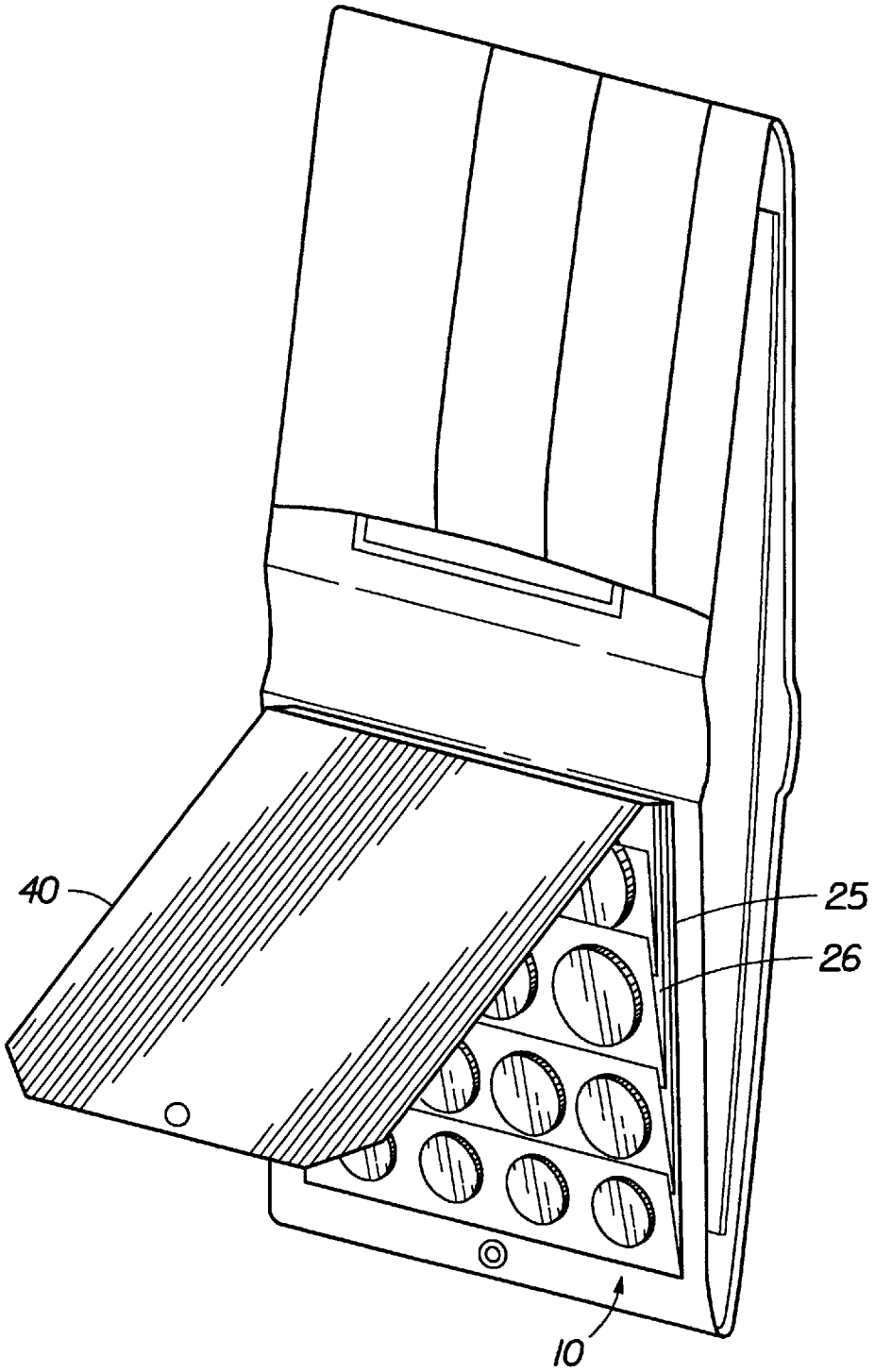
FIG. 1 Is a perspective view of an open wallet installed with the apparatus, FIG. 2 Is a cross section of the stacked troughs, and FIG. 3 Is a front view of the apparatus illustrating the position of apertures and troughs.
Figure 2:
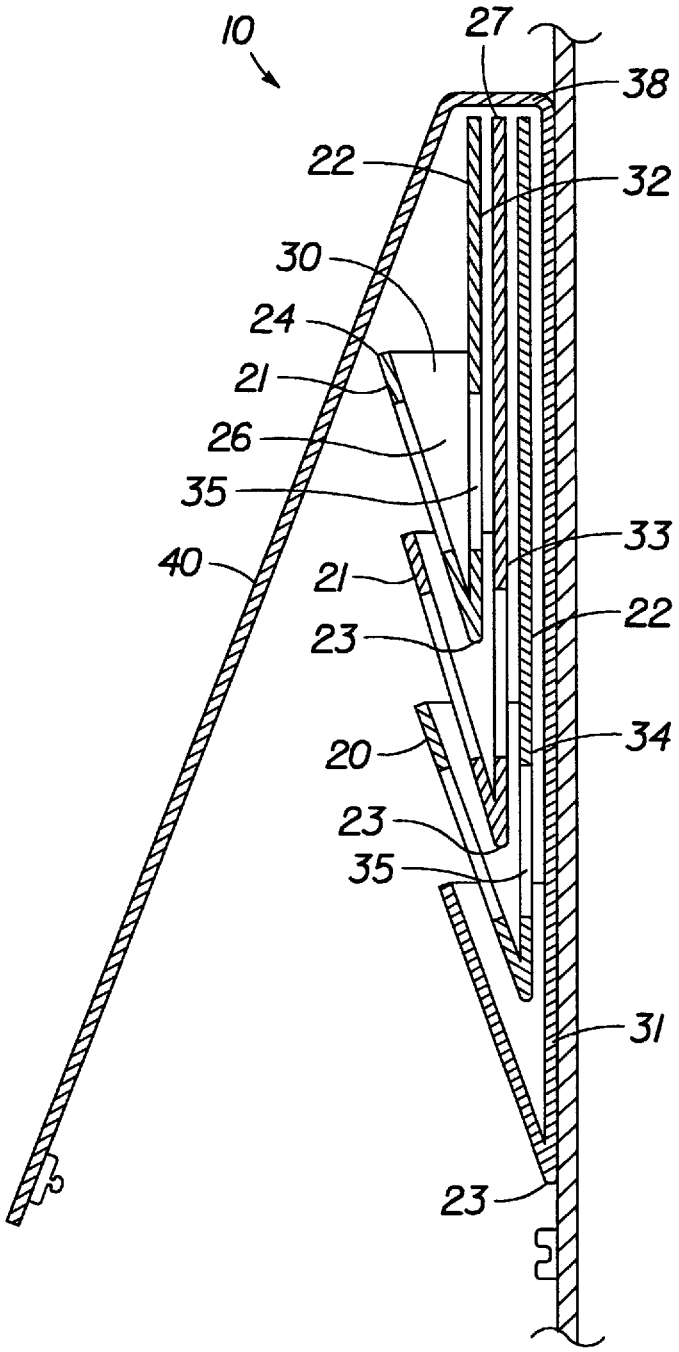
Figure 3:
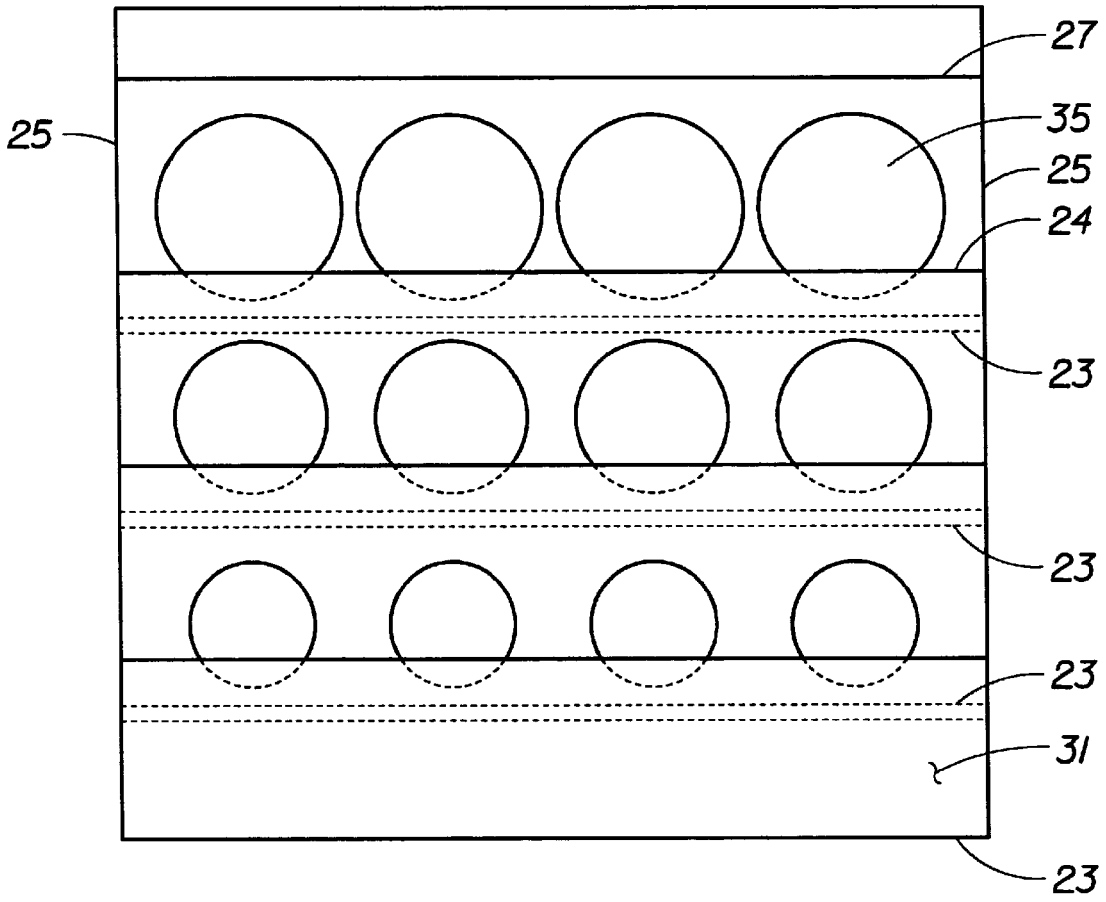

The device is illustrated generally installed upon a wallet in FIG. 1, while FIG. 2 illustrates a cross section of the stacked troughs and finally FIG. 3 is a front view of illustrating the positioning of the apertures and the troughs. The apparatus utilizes gravity and the natural agitation experienced by a purse or wallet while carried by a walking person. Briefly, coins are deposited into a top trough, as the coins are agitated smaller diameter coin pass through top trough apertures and fall into the next lower trough. The top trough apertures, when classifying United States currency coins, will not allow the passage of quarters, but will allow the passage of nickels, pennies, and dimes. The second trough prevents the passage of nickels and allows the passage of dimes and pennies. The third trough prevents the passage of pennies and allows the passage of dimes into a forth bottom trough which has no apertures. The coins are thus retained in separate retention areas and easily accessible to the user. The apparatus may be utilized to classify any currency coin, given the appropriate aperture size. The apparatus may also be used to separate any disc material, such as flat washers. Many times, as in hardware stores which sell numerous fasteners, the bins for storing washers frequently become a confusing mix of all sizes of washers sold by the store. This invention can be used to quickly separate washers based on size, alleviating the confusion of mixed washer bins and saving employee time the apertures in the second trough will allow the passage of pennies and dimes while retaining nickels. As the passing coins leave the second trough 33 they enter the third trough 34, the apertures in the third trough 34 allow the passage of dimes while retaining pennies. As the dimes pass through the third trough apertures they enter the bottom trough, which has no apertures. Accordingly, the coin are retained in troughs based upon their diameter.

The trough's front panels 21 extend from the trough bottom 23 to the front panel top edge 24, while the back panels 22 extend from the bottom 23 to the back panel top edge 27. The dimensions of the panels depends upon the size of the apertures and ultimately the diameter of the discs to be classified, the panels should most preferably extend from the trough bottom 23 to both top edges 24, 27 a distance equal to about 120% of the diameter of the largest disc which would be in that trough. The apertures in the troughs are most preferable positioned through both panels 21, 22 and there should be at least two apertures in a given trough. The apertures are also positioned upon the troughs so that as discs enter the trough bottom, the discs, which should pass, will naturally move through the aperture, most preferable the apertures are located near the bottom 23 of each trough. When the troughs are stacked, space must be maintained between the stacked troughs so that the discs may freely move within the retaining areas of each trough. For example, when a disc is in the second trough 33 and resting on the second trough bottom 23, the top edge of the disc should not touch the bottom of the top disc, most preferable the distance between the stacked trough bottoms should equal about 120% of the largest diameter disc that would be in that trough. The front panels 21, after stacking the troughs, should extend to cover at least about 30% of the aperture on the trough stacked directly above that trough. This assures that discs which pass through apertures on the front panels will be caught be the next for accomplishing the task of separating washers.

The apparatus 10 is constructed of numerous stacked troughs 20, the troughs cross section is the general shape of a "V" where the space between the bottom of the trough and two panels formed by the trough material form a disc retention area 30. The troughs are constructed by folding one edge of either square or rectangular flat material forming an envelope type arrangement. The outside edges 25 of the troughs, formed by the folded material, are sealed with a triangular piece 26 of material or most preferable simply sewed together which prevents discs from fall out the trough ends. The material used to construct the apparatus may be either processed leather, simulated leather, plastic, sheet metal, paper, or a combination of any of the material. The material used to construct the front panels 21 is most preferrable a transparent material, allowing for a visual inspection of discs within each trough. The folded material forms a front panel 21, and back panel 22 and a bottom area 23. The troughs are stacked as illustrated in FIG. 2, the number of trough employed depends upon the number of different diameter size disc are desired to be classified. The figures illustrate an apparatus which may be used to separate quarters, nickels, pennies, and dimes, therefore four troughs are used. For the simplest classifications there will always be at least two troughs. All troughs, except the bottom trough 31, are equipped with a plurality of apertures 35. The bottom trough 31 of the stack will always have no apertures and furthermore the bottom trough also functions to retain the smallest diameter disc classified. The top trough 32 functions as the mixed disc deposition area and also as the trough which retains the largest diameter disc. The apertures 35 in the top trough, in the illustrated example, are deminsioned to allow passage of nickels, pennies, and dimes, while retaining quarters. As the passing coins leave the top trough 32 they enter the second trough 33, lower trough.

The back panels 22 may either terminate directly above the aperture on the trough stacked immediately above, or the back panels 22 may be extended to terminate at a common point, most preferable the back panels 22 are of varying length facilitating alignment of the back panel top edges 27 at a common point which can either be closed together by a securing device, such as sewing. The back panel top edges may also be left open, if desired, allowing a means for emptying the troughs. The bottom trough 31 back pane 38 may be extended to form a cover flap 40 for all the troughs.

I claim:

1. An apparatus for classifying discs by diameter size, comprising:

a) a plurality of stacked troughs, a cross section of each trough resembling a "V" with sides secured forming a horizontal trough having a bottom and front and back panels, the front panel extending from the trough bottom to a front top edge, and the back panel extending from the trough bottom to a back top edge, the back panel extending above the front panel, the space between the bottom, front and back panels forms a disc receptacle, the number of troughs equalling the number of disc diameter sizes desired to be classified, b) stacking the troughs so that the bottom of a trough is placed into the disc receptacle of the trough immediately below it, the first trough in the stack being a top trough while the last trough in the stack being the bottom trough, repeating the stacking of troughs until all troughs are stacked, c) a plurality of disc apertures positioned upon all troughs except the bottom trough, the bottom trough having no apertures, said apertures extending through both the front and back panels, the apertures on a given trough further having the same diameter said diameter which allows all discs to pass through the apertures except discs desired to be retained in the given trough, the apertures further being positioned upon the front and back panels near the bottom of the trough so that when discs are placed into the trough the smaller diameter discs will easily pass through an aperture.

2. The apparatus as set forth in claim 1 wherein said trough back top edge for each stacked trough are aligned.

3. The apparatus as set forth in claim 1 wherein said bottom trough back top edge further includes am extended flap panel portion which when folded over all the stacked troughs securing panel flap for securing discs within the disc receptacle.

4. The apparatus as set forth in claim 1 wherein said front panels are constructed of transparent material allowing visual observation of discs with the disc receptacle area.

5. The apparatus as set forth in claim 1 wherein said apparatus is installed within a wallet, or purse.

6. The apparatus as set forth in claim 1 wherein after said troughs are stacked, the front panel top edge of a lower trough covers about a lower 30% of the aperture on the trough stacked directly above the lower trough.

7. The apparatus as set forth in claim 1 wherein after said troughs are stacked a bottom edge of a upper trough does not extend below a top edge of an aperture located on a lower trough.

8. The apparatus as set forth in claim 1 wherein said trough back top edge, for each stacked trough below the top trough, extends to a point and is fixidely secured to an upper trough back panel above the upper trough apertures.

9. The apparatus as set forth in claim 1 wherein said troughs are constructed of sheet metal.

10. The apparatus as set forth in claim 1 wherein said troughs are constructed of pliable resilient material.

11. An apparatus for classifying currency coins by diameter size, comprising:

a) a plurality of stacked troughs, a cross section of each trough resembling a "V" with sides secured forming a horizontal trough with a bottom and front and back panels, the front panel extending from the trough bottom to a front top edge, and the back panel extending from the trough bottom to a back top edge, the back panel extending above the front panel, the space between the bottom, front and back panels forming a coin receptacle, the number of troughs equalling the number of coin diameter sizes desired to be classified, b) stacking the troughs so that the bottom of a trough is placed into the coin receptacle of the trough immediately below it, the first trough in the stack being a top trough while the last trough in the stack being the bottom trough, repeating the stacking of troughs until all troughs are stacked, c) a plurality of coin apertures positioned upon all troughs except the bottom trough, the bottom trough having no apertures, said apertures extending through both the front and back panels, the apertures on a given trough further having the same diameter said diameter which allows all coins to pass through the apertures except coins desired to be retained in the given trough, the apertures further being positioned upon the front and back panels near the bottom of the trough so that when coins are placed into the trough the smaller diameter coins will easily pass through an aperture.

12. The apparatus as set forth in claim 11 wherein said trough back top edge for each stacked trough are aligned.

13. The apparatus as set forth in claim 11 wherein said bottom trough back top edge further includes am extended flap panel portion which when folded over all the stacked troughs securing panel flap for securing discs within the disc receptacle.

14. The apparatus as set forth in claim 11 wherein said front panels are constructed of transparent material allowing visual observation of discs with the disc receptacle area.

15. The apparatus as set forth in claim 11 wherein said apparatus is installed within a wallet, or purse.

16. The apparatus as set forth in claim 11 wherein after said troughs are stacked, the front panel top edge of a lower trough covers about a lower 30% of the aperture on the trough stacked directly above the lower trough.

17. The apparatus as set forth in claim 11 wherein after said troughs are stacked a bottom edge of a upper trough does not extend below a top edge of an aperture located on a lower trough.

18. The apparatus as set forth in claim 11 wherein said trough back top edge, for each stacked trough below the top trough, extends to a point and is fixidely secured to an upper trough back panel above the upper trough apertures.

19. The apparatus as set forth in claim 11 wherein said troughs are constructed of pliable resilient material.

20. A method of classifying currency coins by diameter size utilizing an apparatus comprising a plurality of stacked troughs, a cross section of each trough resembling a "V" with sides secured forming a horizontal trough with a bottom and front and back panels, the front panel extending from the trough bottom to a front top edge, and the back panel extending from the trough bottom to a back top edge, the back panel extending above the front panel, the space between the bottom, front and back panels forming a coin receptacle, the number of troughs equalling the number of coin diameter sizes desired to be classified, wherein said troughs are stacked so that the bottom of a trough is placed into the coin receptacle of the trough immediately below it, the first trough in the stack being a top trough while the last trough in the stack being the bottom trough, repeating the stacking of troughs until all troughs are stacked, a plurality of coin apertures positioned upon all troughs except the bottom trough, the bottom trough having no apertures, said apertures extending through both the front and back panels, the apertures on a given trough further having the same diameter said diameter which allows all coins to pass through the apertures except coins desired to be retained in the given trough, the apertures further being positioned upon the front and back panels near the bottom of the trough so that when coins are placed into the trough the smaller diameter coins will easily pass through an aperture, the method comprising the steps:

a) depositing all coin desired to be classified into the top trough, and b) agitating the apparatus so that the coins pass through apertures and are retained by the trough with apertures which will not allow the coins passage.

21. Method as set forth in claim 20 wherein said agitation is supplied by normal movement of a wallet or purse carried by a person.

22. Method as set forth in claim 20 wherein said apparatus is installed within a wallet or a purse.

* * * * *